US007717187B1

(12) United States Patent
Miller et al.

(10) Patent No.: US 7,717,187 B1
(45) **Date of Patent: *May 18, 2010**

(54) METHOD, SYSTEM AND APPARATUS FOR RETARDING FIRE

(76) Inventors: John C. Miller, 2274 W. Dovewood Ln., Fresno, CA (US) 93711; Deborah L. Miller, 2274 W. Dovewood Ln., Fresno, CA (US) 93711

( * ) Notice: Subject to any disclaimer, the term of this patent is extended or adjusted under 35 U.S.C. 154(b) by 738 days.

This patent is subject to a terminal disclaimer.

(21) Appl. No.: 11/452,666

(22) Filed: Jun. 14, 2006

Related U.S. Application Data

(63) Continuation-in-part of application No. 10/757,705, filed on Jan. 14, 2004, now Pat. No. 7,225,882.

(51) Int. Cl.
*A62C 2/00* (2006.01)

(52) U.S. Cl. ..... 169/45; 169/46; 169/48; 169/49; 169/50; 169/54; 52/3; 428/921; 442/302; 442/414

(58) Field of Classification Search ..... 169/45, 169/46, 48, 49, 50, 54, 70; 52/1, 3, 5, DIG. 12; 428/920, 921; 252/2, 3, 8.05; 442/301, 302, 442/402, 414, 415; 454/168–170
See application file for complete search history.

(56) References Cited

U.S. PATENT DOCUMENTS 2,720,269 A 10/1955 Diacos
4,212,920 A 7/1980 Seamans
4,510,081 A 4/1985 Bronner et al.
4,610,311 A 9/1986 Bronner et al.
4,992,481 A 2/1991 von Bonin et al.
5,083,617 A 1/1992 Pierce, Jr.

(Continued)

OTHER PUBLICATIONS

Precision Lift, Inc. "Fire-Blocking Get" (4 pages as printed), as accessed Dec. 5, 2003, now at www.precisionleftinc.com/gel.shtml.

*Primary Examiner*—Steven J Ganey
(74) *Attorney, Agent, or Firm*—Law Office of Joan I. Norek; Joan I. Norek

(57) ABSTRACT

A self-protecting barrier for retarding fire has a combustible hydric member or a network of combustible hydric members having an ignition temperature above 100° C., at least a first surface which is water-permeable and may be flammable, and a sufficient water absorption capacity for fire retardation. The hydric members may be foamed-polymer elements, or superabsorbent polymer-filled matrixes, or loose superabsorbent polymer-filled pouches or pockets. A self-protecting barrier system for retarding fire further includes fire adjacent the water-permeable surface and steam between the water-permeable surface and the fire, and may further include a combustible object adjacent the barrier opposite the fire. A method of isolating a combustible object from the flames of a fire includes the steps of providing at least one fire-retardant barrier between the object and the flames, volatilizing or boiling a portion of the hydration water at a temperature of about 100° C. to form a first steam layer at the first surface and deterring ignition of the hydric member and preventing the flames from reaching the object by substantially extinguishing the flames with the first steam layer. The method may also include the steps of allowing the first steam layer to dissipate, and then removing the barrier, and other steps.

13 Claims, 5 Drawing Sheets

U.S. PATENT DOCUMENTS

| | | | |
|---|---|---|---|
| 5,099,532 | A | 3/1992 | Thomas et al. |
| 5,103,816 | A | 4/1992 | Kirschbaum et al. |
| 5,190,810 | A | 3/1993 | Kirschbaum et al. |
| 5,225,236 | A | 7/1993 | Keusch et al. |
| 5,230,959 | A | 7/1993 | Young, Sr. et al. |
| 5,324,578 | A | 6/1994 | Weinberg |
| 5,849,210 | A | 12/1998 | Pascente et al. |
| 5,885,912 | A | 3/1999 | Bumbarger |
| 6,319,573 | B1 | 11/2001 | Lokken |
| 6,371,977 | B1 | 4/2002 | Bumbarger et al. |
| 6,521,362 | B2 | 2/2003 | Koeppen |
| 6,742,305 | B2 | 6/2004 | Rogers et al. |
| 6,806,215 | B2 | 10/2004 | Grilliot et al. |

METHOD, SYSTEM AND APPARATUS FOR RETARDING FIRE

This application is a continuation in part of application Ser. No. 10/757,705, file Jan. 14, 2004 now U.S. Pat. No. 7,255, 882, inventors Miller et al., for Method and Apparatus for Retarding Fire.

BACKGROUND OF THE INVENTION

The present invention is directed to an apparatus, system and method for retarding fire. The present invention is directed particularly to a fire-retardant barrier, a system which includes the fire-retardant barrier and a method which employs the fire-retardant barrier. The barrier retards fire from burning materials, such as buildings and other structures, forests and other vegetative materials, and the like. All of such materials, being combustible, are fuel for a fire if located in its path.

Wildfires are known periodically to threaten residential areas, and damage or destroy homes. Wildfires not only scorch acres of land by the hundreds of thousands, and destroy homes by the thousands, they are deadly. In early 2006, wildfires in the southern plains of the U.S. caused almost a dozen fatalities and necessitated the evacuation of 1,900 people as the flames raced across more the 1,000 square miles, while the resolute fight against the fires 'from the ground and from the air' consisted of dousing rooftops with water and dumping retardant from air-tankers.

In California, about 5.5 million acres are developed with housing unit densities meeting the Wildland-Urban Interface criteria and are at significant risk (very high or extreme risk) to damage from fire. "The Changing California, Forest and Range 2003 Assessment", frap.cdf.ca.gov/assessment2003, October, 2003. California is not the only at-risk state. It has been reported that 80% of all housing units in New Mexico and Wyoming, and 40% to 55% of housing units in other Western states, including California, Washington and Oregon, are on land with fire potential. Typically, home owners have significant warning as to the likelihood of a fire passing through their residential area so that preventative steps can be taken to avoid damage, provided practical preventative measures are available.

Water has been known for millennia for its ability to prevent or extinguish fires due to its high heat capacity and high heat of vaporization. One method that has been used for retarding fire from burning a building is spraying water on the roof and exterior walls of a building. This method, however, is not particularly effective because water tends to flow off the building, limiting the amount of water that can be placed on, and adhered to, the building's exterior surfaces. Water also tends to evaporate quickly, especially in the heat of a fire. Covering a building with a tarp able to absorb water is also known, see U.S. Pat. No. 6,521,362.

It has been reported that foams or superabsorbent polymer gels formed by adding water to superabsorbent polymer powders have been used as a fire-retardant. However, forming and applying the foam or gel requires special equipment. Only limited amounts of gel or foam can be placed on a surface before the gel or foam begins to slough off. The gels and foams also can require significant cleanup after a fire has passed. Also, the concentrated polymers used to form gels typically are flammable, so that storage of the concentrated polymers can be hazardous.

Superabsorbent polymers have also been used in an insulating composite for body protection in extreme temperature situations. See U.S. Pat. No. 5,885,912 for a "Protective Multi-Layered Liquid Retaining Composite."

What is needed is a method and a system that provide effective retardation of a fire, and an apparatus for retarding fire that is easy and safe to store, that is easy to apply to an object and/or area or locale, and that is easy to clean up after a fire has passed.

BRIEF SUMMARY OF THE INVENTION

A barrier for covering a substantial area, either continuously or discontinuously, for retarding fire from burning a substance, such as an object or vegetation on an expanse of land, is provided. The bather has at least one hydric member. The hydric member or members each have at least one water-permeable surface. The water-permeable surfaces alone or collectively in embodiments have a substantial surface area, and have a sufficient water absorption capacity, in terms of pounds of water per square foot of surface area, for fire retardation. In some embodiments of the invention, the hydric member is a foamed polymer, such as polyurethane foam. In other embodiments of the invention, the hydric member is a matrix containing superabsorbent polymer. In further embodiments of the invention, the hydric member is a precursor to a substantially continuous matrix of hydrated superabsorbent polymer held within a pouch or pocket. In some embodiments of the invention, the barrier is an array of small hydric members.

Also provided is a barrier for retarding fire from burning an object, structure and/or an area or locale, which barrier has at least one hydric member hydrated to a sufficient degree, in terms of pounds of water per square foot of surface area, for fire retardation. The hydric member or members have a sufficiently water-permeable surface or surfaces so that water contained in the hydric member or members will volatilize or boil to form a layer of steam at a temperature of about 100° C. when the surface or surfaces are exposed to flame or intense heat.

Also provided are systems for retarding fire from burning fuel. In an embodiment, the system includes a fire-retardant barrier of the present invention interposed between fuel and a fire, and a layer of steam at a temperature of about 100° C. at the surface or surfaces of at least one hydric member, the steam layer interposed between the fire and the bather.

Also provided are methods for retarding fire from burning an object and/or area or locale. In an embodiment, the method includes the steps of providing a fire-retardant barrier of the present invention, covering at least a substantive portion of the object and/or area with the fire-retardant bather with at least a portion of the water-permeable surface or surfaces of the hydric member or members faced outward, hydrating the hydric member or members, either before or after the bather is positioned, to a sufficient degree in terms of pounds of water per square foot of surface area, and volatilizing or boiling hydration water to steam at a temperature of about 100° C. at the surface or surfaces.

The term hydric as used herein includes the sense of its adjectival definition of being characterized by, relating to, or requiring an abundance of water. See for example Webster's Seventh New Collegiate Dictionary, G. & C. Merriam Co., Springfield, Mass. A hydric member of the present invention has a significant capacity to hold water. Upon hydration, the hydrated hydric member not only holds a significant amount of water, but holds the water available for steaming at a temperature of about 100° C. when exposed to fire or elevated temperature.

These and other features and advantages are evident from the following description of the present invention, with reference to the accompanying drawings.

DETAILED DESCRIPTION OF THE INVENTION

Figure 1:
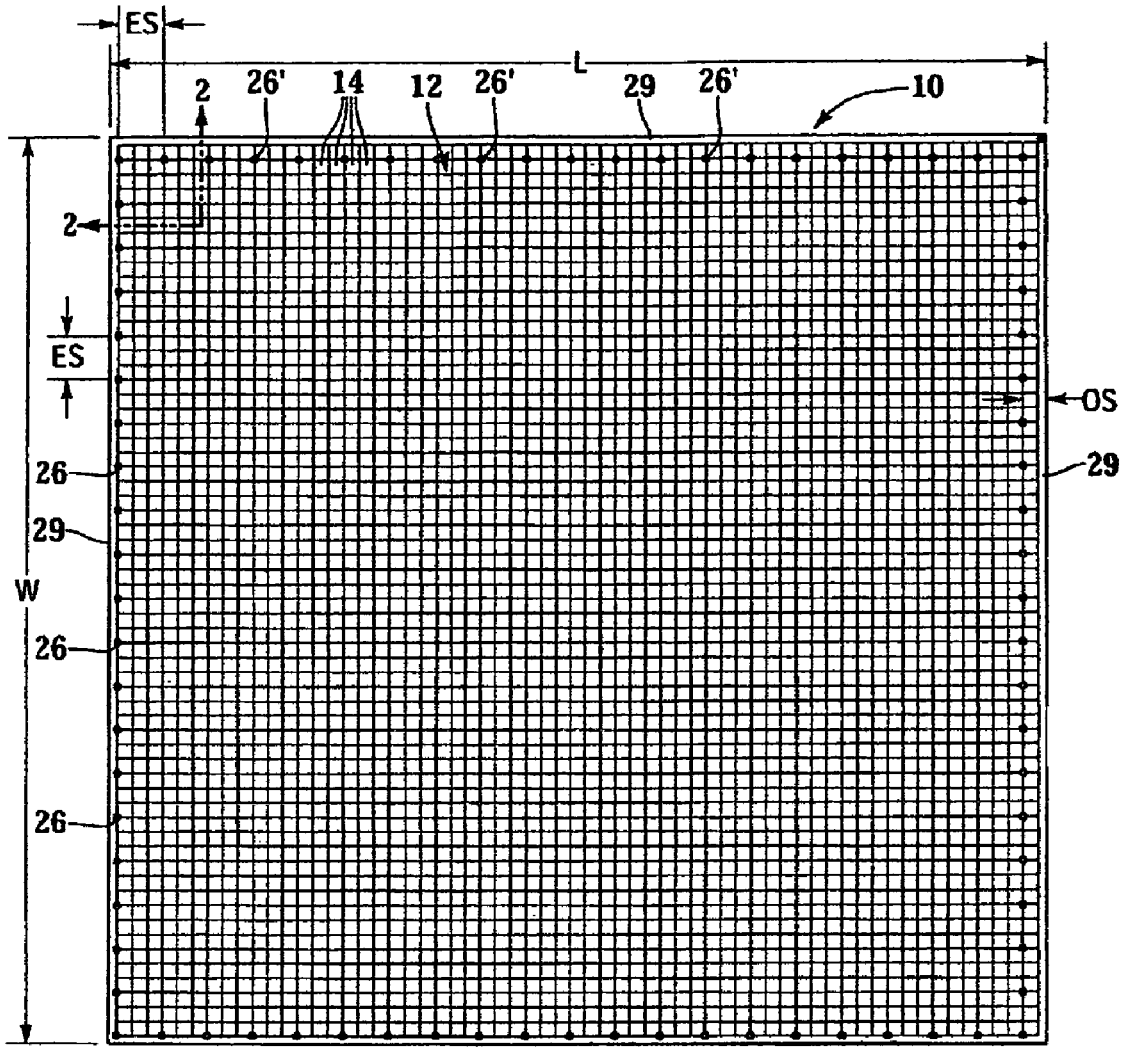
FIG. 1 is an elevation view of a fire-retardant barrier.

Referring to FIGS. 1, 2, 3, and 9, a fire-retardant barrier 10 is shown for retarding fire, such as for retarding fire from burning an object, such as a building or other structure 2. Fire-retardant barrier 10 includes water-permeable fabric 12 for covering a substantial area, wherein fabric 12 has at least nine pockets 14 per square foot, each pocket 14 having a volumetric capacity of between about 0.03 cubic inch and about seventeen cubic inches, wherein substantially all of pockets 14 contain between about 0.01 grams and about 2 grams of substantially only loose superabsorbent polymer 16 per cubic inch of volumetric capacity of pockets 14. In this instance, the barrier 10 is comprised of a plurality of hydric members, namely precursors to a plurality of substantially continuous matrixes of hydrated superabsorbent polymer held within the pockets 14.

A fire requires three components, fuel, oxygen, and heat energy sufficient to ignite the fuel. If any one of these components is removed, a fire will not burn. Fire-retardant barrier 10 and other embodiments of the invention isolate an object (the fuel) from the flames 40 (ignition heat) and from oxygen to retard the flames 40 from burning the object. Barrier 10 uses the most effective and economical substance used for fire prevention, i.e. water, by incorporating it into an easy-to-use apparatus where it is available to steam, that is, to volatilize or boil at a temperature of about 100° C. when exposed to fire or the intense elevated temperatures in the vicinity of a fire. The steam produced and emitted excludes oxygen. Steam is a gas that, like carbon dioxide, does not support combustion. (Carbon dioxide is a gas which is commonly used to extinguish fires.) The steam production and the fast heat transfer within the hydric member or members provide a critical heat buffering property to the barrier 10 and other embodiments of the invention.

Barrier 10, like the barriers of some other embodiments of the invention, is designed for use in protecting an object or structure 2, such as a house or other building, but it is envisioned that barrier 10 can be used to protect other objects, such as automobiles, trees, shrubs and other plants, as a firebreak to prevent the spread of a fire, or for extinguishing fires, such as a cover for ensuring camp fires are smothered, or for isolating and extinguishing petroleum or other chemical fires. For purposes of clarity, fire-retardant barrier 10 is described for use in retarding fire from burning structure 2, however, it is envisioned that fire-retardant barrier 10 and barriers of other embodiments of the invention can be used as a firebreak or other fire-retarding apparatus.

Barrier 10 holds water in a substantially continuous hydrated matrix so that the water is more effective in retarding fire. Barrier 10 uses the high heat capacity and the high heat of vaporization of water to temporarily prevent structure 2 or other object or expanse of land from reaching a temperature high enough to burn. Barrier 10 absorbs a large amount of water in a superabsorbent material, preferably a superabsorbent polymer 16 that is hydrated with a large amount of water. When a fire encounters structure 2, the water absorbed in barrier 10 disperses a large amount of heat from the fire by volatilizing the water to form steam. As the steam is formed, the temperature of the flames is lowered, thus reducing the heat available to propagate the fire. Additionally, the temperature of barrier 10 will not exceed the boiling point of water until all of the water is evaporated. The barrier 10 is a heat buffer, and the barrier 10 cannot reach a temperature that is high enough to ignite the covered structure 2 until the point of water depletion.

Figure 6:
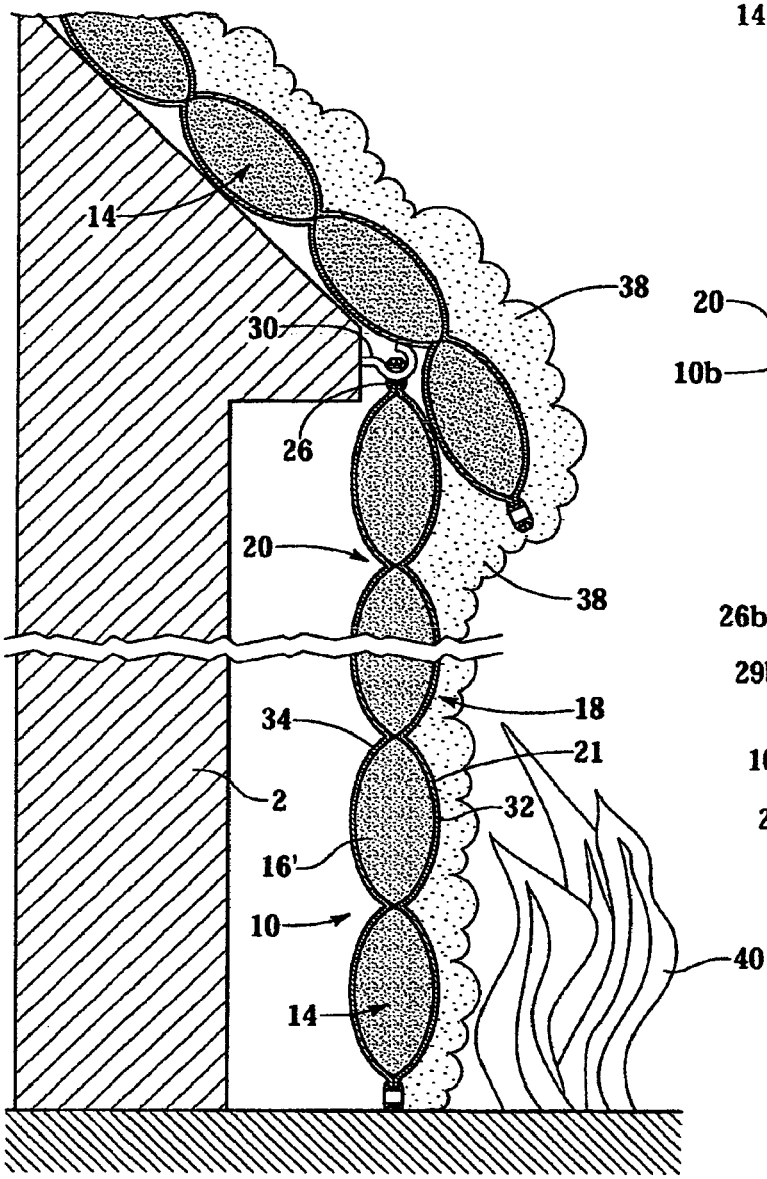
FIG. 6 is a side-sectional view of the fire-retardant bather fastened to a structure, wherein a fire is present adjacent to the structure.

As in other embodiments of the invention, in addition to absorbing heat from the fire, the steam formed by volatilizing the water absorbed in barrier 10 creates a steam layer 38 at the outer surface 21 of barrier 10, see FIG. 6. Steam layer 38 acts as a fire extinguisher by depriving the fire of oxygen at surface 21 of barrier 10, thus quenching any flames that attempt to form at surface 21. As mentioned above, steam is a gas that does not support combustion. The steam that forms steam layer 38 is continually replenished during a fire because the large amount of water absorbed by superabsorbent polymer 16 is continuously volatilized to form steam layer 38 until all of the water absorbed by superabsorbent polymer 16 is exhausted. Steam layer 38 will continue to protect surface 21 of barrier 10 until all the water is vaporized, or until the fire passes away from structure 2. The formation of steam layer 38 not only aides in retarding fire from burning the object being protected, such as structure 2 (FIG. 9), but also acts to self-protect barrier 10 from burning.

Because barrier 10 is designed to hold a large amount of water in superabsorbent polymer 16, a typical flash fire will burn past structure 2 before all the water in barrier 10 can be evaporated.

The barrier 10 preferably has a water absorption capacity of from about 0.5 to about 10 pounds of water per square foot of surface area, and more preferably from about 2 to about 6 pounds of water per square foot of surface area. In some fire-retardation uses of the barrier 10 and other embodiments, particularly when material costs are not critical factors, the actual degree of hydration used is less than the water absorption capacity of superabsorbent polymers, allowing a quick hydration. Further, the physical constraints of the pockets of the barrier 10 present their own limitation on hydration. In other words, barrier 10 is and should be readily hydratable to tautness, and at such point it can be deemed fully hydrated regardless of whether or not the theoretical maximum hydration degree of the superabsorbent polymer 16 has been reached.

Fire-Retardant Barrier

Fire-retardant barrier 10 is made from water-permeable fabric 12 and in this embodiment it is designed to cover a substantial portion of structure 2. Fabric 12 holds loose superabsorbent polymer 16 so that, when the barrier 10 absorbs a large amount of water, the loose superabsorbent polymer 16 hydrates to a substantially continuous matrix of superabsorbent polymer and its hydration water. Because a large area may have to be covered by one or more fire-retardant bathers 10, and other embodiments of this invention, ease of installation and handling may be a consideration depending on the application. For this reason, bather 10 and other embodiments of this invention may be fabricated to have a size that is easy to manipulate.

Turning back to FIG. 1, barrier 10 may be, as shown, generally rectangular in shape having a length L and a width W to cover a total area of length L multiplied by length W. In one embodiment, length L is between about 5 feet and about 50 feet, preferably between about 10 feet and about 30 feet, still more preferably about 20 feet, and width W is between about 5 feet and about 50 feet, preferably between about 10 feet and about 30 feet, still more preferably about 20 feet so that barrier 10 covers an area of between about 25 square feet and about 2500 square feet, preferably between about 100 square feet and about 900 square feet, still more preferably about 400 square feet. Barrier 10 may be made slightly larger than the area that is desired to be covered to allow for overlap between barrier 10 and adjacent fire-retardant bathers. The specific dimensions of fire-retardant barrier 10 can vary substantially depending on the actual application bather 10 is being used for, such as for a firebreak or to cover a structure 2.

Bather 10 may include a plurality of pockets or segments 14 to form the matrix of fabric 12 and superabsorbent polymer 16. A predetermined amount of superabsorbent polymer 16 is placed in each pocket 14, described below, to absorb a predetermined amount of water. In one embodiment, there are between about 9 and about 600, preferably between about 16 and about 150, still more preferably about 36 pockets per square foot of barrier 10.

Figure 3:
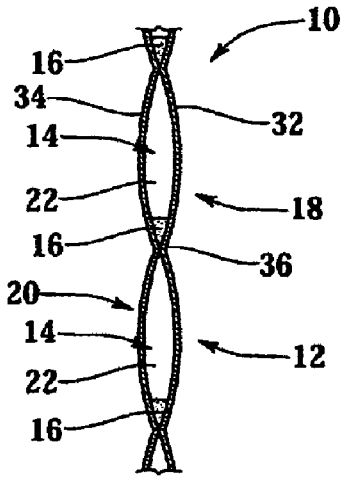
FIG. 3 is a side-sectional view of the fire-retardant barrier which is not hydrated, taken along line 3-3 in FIG. 2.
Figure 4:
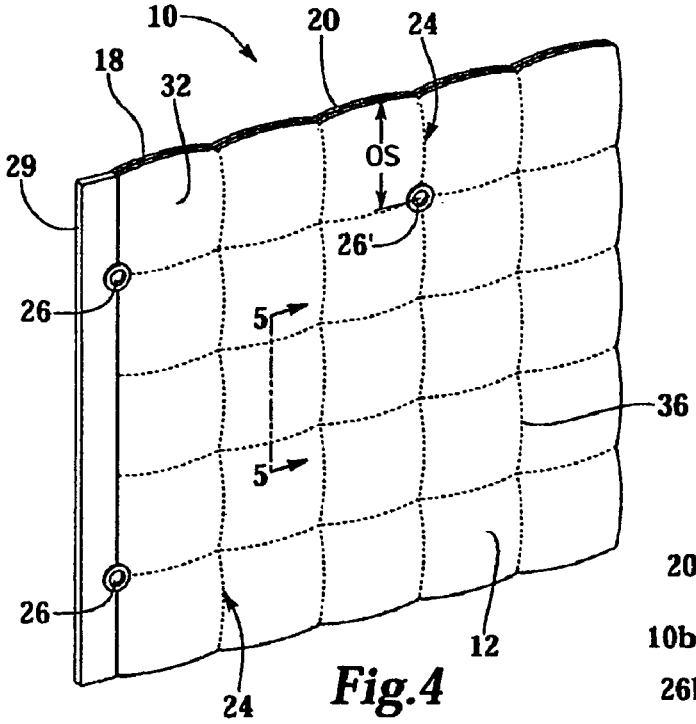
FIG. 4 is a perspective view of the fire-retardant barrier when it is hydrated.

Turning to FIGS. 3, 4, and 6, in one embodiment, bather 10 includes a pair of sheets 18, 20 of fabric 12 which are joined together in a generally quilted pattern to form the plurality of pockets 14. At least one of the sheets 18, 20, i.e. the sheet 18 that faces outwardly from structure 2 (see FIG. 6), is water-permeable and porous to allow water to pass into or out of pockets 14. Outside sheet 18 can be a woven or a non-woven fabric or another porous material capable of allowing water to pass from one side of sheet 18 to the other.

The sheet 20 that faces inwardly toward structure 2 may also be, and preferably is, water-permeable. Barrier 10 and other embodiments of the invention having an inwardly-facing water-permeable sheet 20 may be hydrated at a faster speed when a barrier-immersion hydration method is employed. When hydration methods other than barrier immersion are employed, the water-permeable inner sheet still provides advantages in some embodiments. The steaming of the hydration water through the inwardly-facing sheet 20 provides another degree of protection to the structure 2.

Sheets 18, 20 should be made from a material that is capable of withstanding the boiling point of water without burning, melting, or degrading. Sheets 18, 20 should be strong enough to physically support superabsorbent polymer 16 and the large amount of water that it can absorb. Water-permeable sheet 18, and in embodiments water-permeable sheet 20, should also be sufficiently water-permeable to allow water to quickly permeate into pocket cavity 22 so that the step of hydrating barrier 10 (described below) can be done quickly, and to allow water vapor and steam to easily exit cavity 22 to avoid pressure buildup in pockets 14.

In preferred embodiments, sheets 18, 20 are a hydrophilic porous material, including woven materials such as cloth, i.e. cotton, muslin, polyesters, engineered fabrics, porous woven or non-woven synthetic materials or natural materials. The hydrophilic characteristic enhances quick hydration of the barrier regardless of the hydration method used, for instance submersion of the barrier in water, spraying of water onto the barrier and the like. Hydrophilic sheets 18, 20 are particularly of value when the barrier hydration is done under time and/or effort constraints. For example, when a bather is positioned on a slanted roof, and water is being sprayed onto it from a standard garden hose, hydrophilic sheets 18, 20, or at least the externally-facing one of them, will facilitate the soaking in of almost all the water that strikes such fabric, rather than a homeowner wasting time and effort by having some, or even most, of the sprayed water bounce or drain off a hydrophobic fabric. Hydrophilic sheets 18, 20 can lead to a successful hydration in critical situations while hydrophobic sheets can thwart the hydration process. In addition, the hydrophilic characteristic enhances not only the quick hydration but also the constant steaming through the fabric during use of preferred embodiments of the invention.

Sheets 18, 20 are joined together by one or more joining elements, such as stitches or staples, wherein the joining elements form pockets 14. Preferably, the joining elements join sheets 18, 20 together so that each pocket 14 is substantially enclosed and isolated from other pockets 14. In one embodiment, shown in FIGS. 2 and 4, sheets 18, 20 are joined together with stitches 24 that form seams 36 around the periphery of each pocket 14.

As described above, it may be desirable to fabricate barrier 10 to a small size that is easy to manipulate. However, because large areas may need to be protected, one or more barriers 10 may be necessary. It may be desirable to overlay portions of the plurality of barriers 10 to form a complete barrier system to cover large areas. In other embodiments, a discontinuous array of small bathers, including single hydric-member barriers, are used to protect large areas, as described further below.

Figure 5:
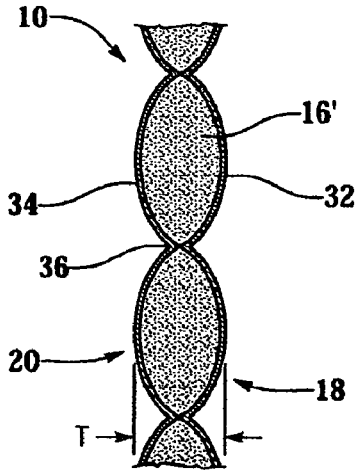
FIG. 5 is a side-sectional view of the hydrated fire-retardant bather, taken along line 5-5 in FIG. 4.

The amount of space taken up by dry superabsorbent polymer 16 (see FIG. 3) in barrier 10 is small relative to the volume of hydrated superabsorbent polymer 16' (see FIG. 5), so that the size of an unhydrated barrier 10 is essentially equal to the size of fabric 12. Similarly, the mass of dry superabsorbent polymer 16 is small relative to the mass of hydrated superabsorbent polymer 16' and the water it has absorbed so that the total mass of dry bather 10 is essentially the mass of fabric 12. This allows barrier 10 to be easily stored and manipulated, such as by folding barrier 10 into a compact space. The ability to easily store barrier 10 allows a user to store a plurality of barriers 10 in a small space when they are not needed.

In preferred embodiments, sheets 18, 20 are a lightweight and sufficiently flexible material, including woven materials such as cloth, i.e. cotton, muslin, polyesters, engineered fabrics, porous woven or non-woven synthetic materials or natural materials. The lightweight characteristic not only enables easy storage and manipulation of the barrier 10 but also immensely facilitates the transport of the barrier 10 to the use/hydration site. Further, in certain preferred embodiments, the material is sufficiently flexible to drape over an object, such as an automotive vehicle or shrubbery, without having such a degree of flimsiness that handling is impaired.

Figure 10:
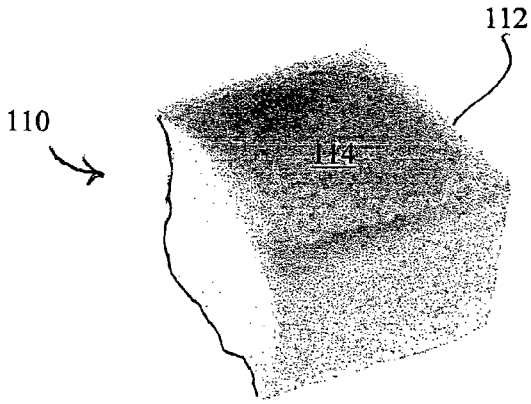
FIG. 10 is a perspective view of a polymer foam fire-retardant bather of the present invention.

Referring now to FIG. 10, a barrier 110 having a foamed-polymer hydric member 112 is shown in partially cut-away view. As seen, the foamed-polymer hydric member 112 is not encased in any fabric or other covering. While a fabric or the like covering for the foamed-polymer hydric member 112 is not excluded from the invention, provided it does not substantially interfere with the use of the barrier 110 for fire-retardation, there generally is no reason to encase a foamed-polymer hydric member of the present invention.

The foamed-polymer hydric member 112 preferably has a sufficient water absorption capacity in terms of pounds of water per square foot of surface area, for fire retardation. The foamed-polymer hydric member 112 has at least one surface, such as the expansive upper surface 114, which is water-permeable. The hydric member or members have a sufficiently water-permeable surface or surfaces, such as upper surface 114, so that water contained in the hydric member or members will volatilize or boil to form a layer of steam at a temperature of about 100° C. when the surface or surfaces are exposed to flame or intense heat.

The foamed-polymer hydric member 112 preferably has a water absorption capacity of from about 0.5 to about 10 pounds of water per square foot of surface area, and more preferably from about 2 to about 6 pounds of water per square foot of surface area, although quick hydration to a level which is less than the water absorption capacity is contemplated by, and within, the present invention.

The foamed-polymer hydric member 112, when hydrated, preferably will hold the absorbed water without undue dripping or draining. Although the loss of water over time from the foamed-polymer hydric member 112, after hydration, is not excluded from the present invention, there is no advantage to such water loss in many applications of the invention. In addition, since the use the foamed-polymer hydric member 112 includes the formation of a steam layer at least one surface, a sufficient amount of water after hydration must be retained to provide such a substantially continuous steam layer as long as the object being protected from fire requires the protection.

The foamed-polymer hydric member 112 shown in FIG. 10 is resilient and flexible. As shown, it is about one inch in depth, and all of its surfaces are water permeable. The present invention does not, however, require all surfaces of foamed-polymer hydric members, such as hydric member 112, to be water permeable. The foamed-polymer hydric member 112 can be hydrated as described above for barrier 10, or it can easily be hydrated by simple immersion into a vat or other supply of water. When immersion is the hydration mode, hydric member 112 is preferably water-permeable at all surfaces for quick hydration.

The selection of the thickness of a foamed-polymer hydric member generally will depend on the thickness required to reach a sufficient degree of hydration per unit area, given the hydration method(s) envisioned, in the time frame(s) envisioned.

The foamed-polymer hydric member 112 shown in FIG. 10, which as mentioned is about one inch in depth, is sufficiently resilient and flexible for the type of handling required when used for the purposes and methods of the present invention. A foamed-polymer hydric member of the present invention should be sufficiently rugged but not so unwieldy that its use is overly impaired. It is believed that foamed-polymer sheets of from about 0.5 to about 5 or 10 inches thick are within a range to provide sufficient ruggedness and sufficient manageability for handling when used as envisioned by the present invention. The present invention, however, does not exclude thinner foamed-polymer hydric members if they provide a sufficient degree of hydration per unit area, or thicker foamed-polymer hydric members, particularly for more extreme circumstances.

Foamed-polymer hydric members, such as the foamed-polymer hydric member 112 shown in FIG. 10, can be formed of any sufficiently hydratable polymer foam material. Polyurethane foam, for instance, has been tested and found sufficiently hydratable, and sufficiently durable and manageable for the purposes of the present invention. In addition, as noted above, covering a foamed-polymer hydric member is not excluded by the present invention, so long as the surface exposed to the fire is water permeable, permitting the layer of steam to form thereon. Therefore the use of coverings or the like to augment the structural integrity of foamed-polymer materials selected for the foamed-polymer hydric member of the present invention is not excluded from this invention.

Figure 11:
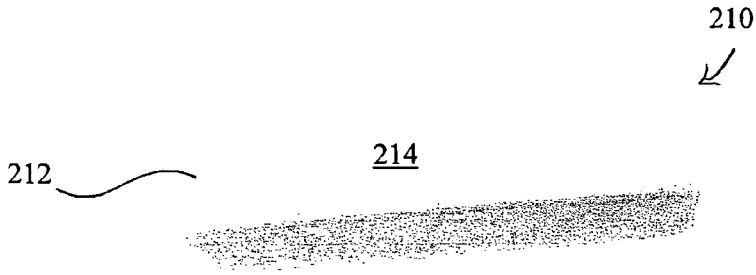
FIG. 11 is a perspective view of a superabsorbent-containing cellulosic matrix fire-retardant barrier of the present invention.

Referring now to FIG. 11, there is shown a barrier 210 having a hydric member 212 which is a matrix containing superabsorbent polymer (not shown). As seen, the superabsorbent polymer-containing matrix hydric member 212 is not encased in any fabric or other covering. A fabric or the like covering for the hydric member 212 is not excluded from the invention provided such a covering does not substantially interfere with the use of the barrier 210 for fire-retardation.

The superabsorbent polymer-containing matrix hydric member 212 preferably has a sufficient water absorption capacity in terms of pounds of water per square foot of surface area, for fire retardation. The superabsorbent polymer-containing matrix hydric member 212 has at least one surface, such as the expansive upper surface 214, which is water-permeable. The hydric member or members have a sufficiently water-permeable surface or surfaces, such as upper surface 214, so that water contained in the hydric member or members will volatilize or boil to form a layer of steam at a temperature of about 100° C. when the surface or surfaces are exposed to flame or intense heat.

The superabsorbent polymer-containing matrix hydric member 212 preferably has a water absorption capacity of from about 0.5 to about 10 pounds of water per square foot of surface area, and more preferably from about 2 to about 6 pounds of water per square foot of surface area.

The superabsorbent polymer-containing matrix hydric member 212, when hydrated, preferably will hold the absorbed water without undue dripping or draining. Although the loss of water over time from the superabsorbent polymer-containing matrix hydric member 212, after hydration, is not excluded from the present invention, there is no advantage to such water loss in many applications of the invention. In addition, since the use the superabsorbent polymer-containing matrix hydric member 212 includes the formation of a steam layer at least one surface, a sufficient amount of water after hydration must be retained to provide such a substantially continuous steam layer as long as the object being protected from fire requires the protection. As mentioned above, steam is a gas that does not support combustion.

The superabsorbent polymer-containing matrix hydric member 212 shown in FIG. 11 is resilient and flexible. As shown, in unhydrated form, it is about ⅜ inch in depth, and all of its surfaces are water permeable. It can be hydrated as described above for bather 10, or hydrated by immersion in a water supply. A hydric member 212 which is water-permeable at substantially all external surfaces is preferred for quick hydration purposes, particularly when immersion is the selected hydration mode.

The selection of the thickness of a superabsorbent polymer-containing matrix hydric member generally will depend on the thickness required to reach a sufficient degree of hydration per unit area, given the hydration method(s) envisioned, in the time frame(s) envisioned.

The superabsorbent polymer-containing matrix hydric member 212 shown in FIG. 11, which as mentioned is about ⅜ inch in depth, is sufficiently resilient and flexible for the type of handling required when used for the purposes and methods of the present invention. A superabsorbent polymer-containing matrix hydric member of the present invention should be sufficiently rugged but not so unwieldy that its use is overly impaired. It is believed that superabsorbent polymer-containing matrix sheets in unhydrated form of from about 0.2 to about 5 or 10 inches thick are within a range to provide sufficient ruggedness and sufficient manageability for handling when used as envisioned by the present invention. The present invention, however, does not exclude thinner superabsorbent polymer-containing matrix hydric members if they provide a sufficient degree of hydration per unit area, or thicker superabsorbent polymer-containing matrix hydric members, particularly for more extreme circumstances.

Superabsorbent polymer-containing matrix hydric members, such as the superabsorbent polymer-containing matrix hydric member 212 shown in FIG. 11, can be formed of any sufficiently hydratable superabsorbent polymer-containing matrix material. A superabsorbent polymer-containing cellulosic sheet, for instance, has been tested and found sufficiently hydratable, and sufficiently durable and manageable for the purposes of the present invention. In addition, as noted above, covering a superabsorbent polymer impregnated matrix hydric member is not excluded by the present invention, so long as the surface exposed to the fire is water permeable, permitting the layer of steam to form thereon. Therefore the use of coverings or the like to augment the structural integrity of such materials selected for the hydric member of the present invention is not excluded from this invention.

Superabsorbent polymer-containing matrix hydric members, such as the superabsorbent polymer-containing matrix hydric member 212 shown in FIG. 11, can be fabricated by an air-laid, or air-blown, process. When such a matrix is cellulosic, for instance, it would be fabricated from wood pulp, plus the desired superabsorbent polymer (in dry particulate form) plus binding material such as polyesters, polyethylene and the like.

It is noted that the materials suitable for the hydric member of the barrier of the present invention need not be fire resistant to any degree. Polyurethane foam and cellulose, for instance, are combustible materials. Upon hydration in accordance with the present invention, these materials are protected against combustion as are the objects they protect.

Figure 8:
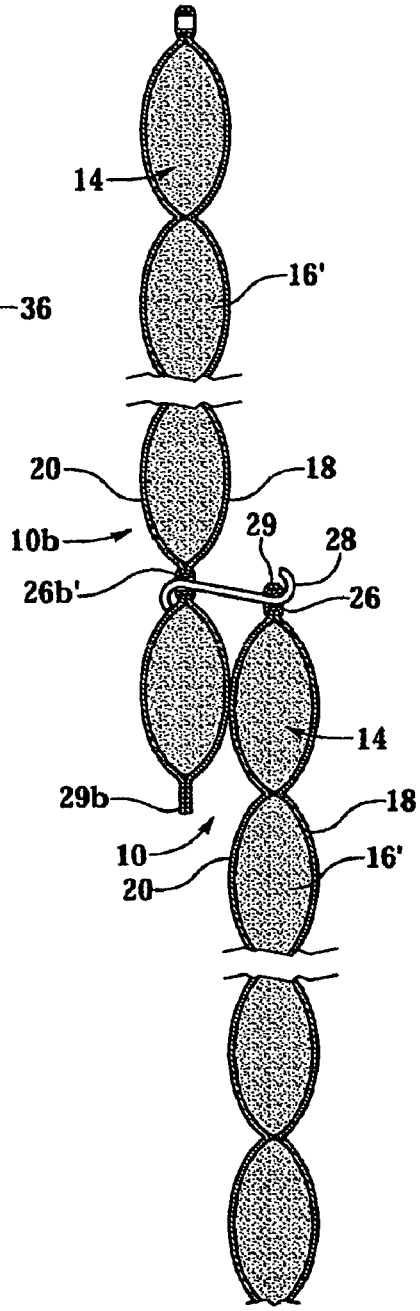
FIG. 8 is a side-sectional view of the fire-retardant barrier fastened to a second fire-retardant bather with an alternative fastening means.
Figure 7:
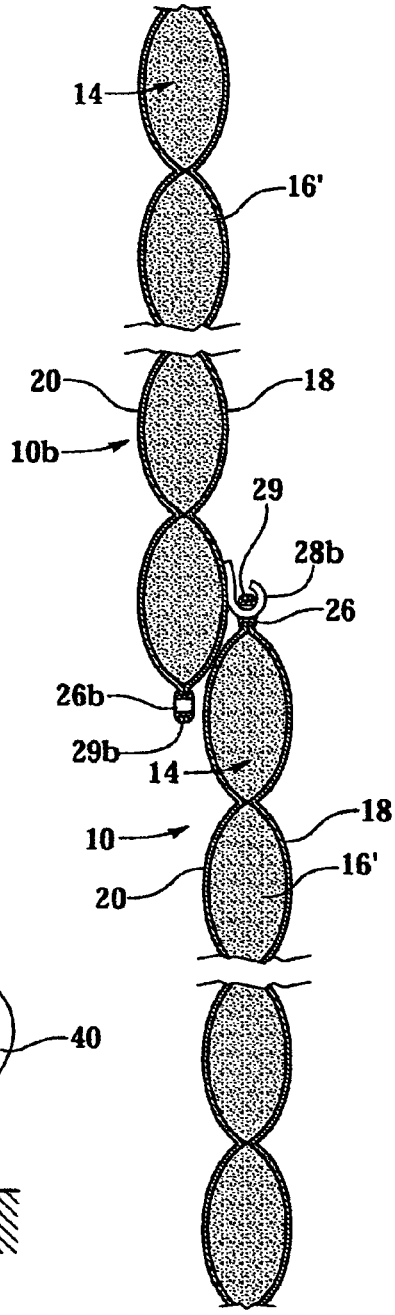
FIG. 7 is a side-sectional view of the fire-retardant barrier fastened to a second fire-retardant barrier.

Turning to FIGS. 7 and 8, it may be desirable for a barrier of the present invention, as illustrated for barrier 10, to include means for fastening barrier 10 to another bather 10*b*, such as a fastener on barrier 10 which engages with a fastener on second barrier 10*b*, so that a plurality of barriers 10, 10*b* can be linked together.

In one embodiment, shown in FIG. 7, a second barrier 10*b* includes fasteners 28*b*, shown as hook 28*b*, spaced from an edge 29*b* of barrier 10*b*. Spaced fastener 28*b* engages a fastener on bather 10, shown as an eyelet 26, which can either be at edge 29 of bather 10, as shown in FIG. 7, or spaced from edge 29. Fasteners spaced from the edge of the barrier allow barrier 10 and second barrier 10*b* to overlap to prevent gaps between bathers 10, 10*b* to reduce the likelihood that sparks, burning debris, hot air, or other components that can ignite structure 2, will bypass barriers 10, 10*b*. The same or other mechanical fasteners can be used to fasten together other embodiments of the barrier of the present invention, for instance foamed polymer sheets and sheets of superabsorbent polymer impregnated matrixes.

In one embodiment, shown in FIG. 1, bather 10 includes a plurality of eyelets 26, 26' evenly spaced around the periphery of barrier 10, wherein each eyelet 26, 26' is spaced a predetermined distance ES from adjacent eyelets 26, 26'. The distance ES is small enough to provide support evenly along the length or width of barrier 10. In one embodiment, distance ES is between about 1 inch and about 18 inches, preferably between about 2 inches and about 12 inches, still more preferably about 6 inches.

Figure 2:
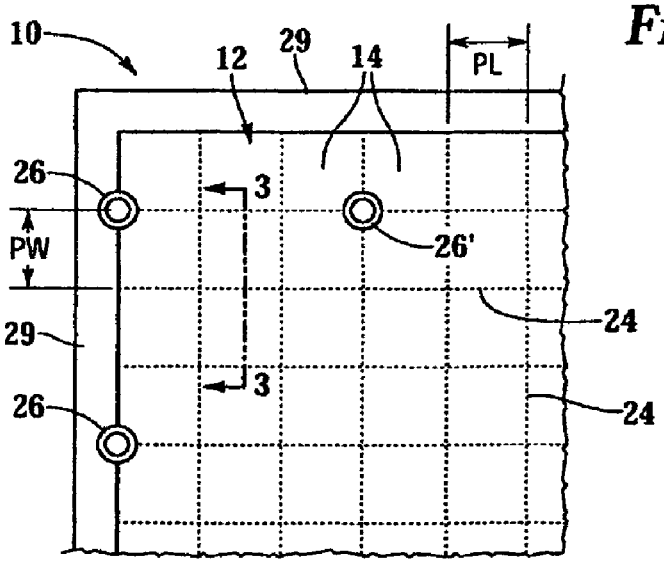
FIG. 2 is an elevation view of the fire-retardant barrier taken along line 2-2 in FIG. 1.

Turning to FIGS. 1, 2, and 8, in another embodiment, barrier 10 includes a first set of eyelets 26 which are positioned proximate edge 29 along two sides of barrier 10 (shown as the left side and the bottom side in FIG. 1) and a second set of eyelets 26' is positioned along the remaining two sides of barrier 10 (shown as the top side and the right side in FIG. 1) which are spaced from edge 29 by a space OS to allow for overlap between barriers. In one embodiment, the overlap spacing distance OS between edge 29 and the second set of eyelets 26' is between about ½ inch and about 6 inches, preferably between about 1 inch and about 4 inches, still more preferably about 2 inches. Second barrier 10*b* also includes first set of eyelets 26*b* (FIG. 7), and second set of eyelets 26*b'* (FIG. 8) which are spaced from edge 29*b*. Barriers 10 and 10*b* are fastened together by overlapping barriers 10, 10*b* so that first eyelets 26 of barrier 10 are aligned with second eyelets 26*b'* of second barrier 10*b*, as shown in FIG. 8. A fastener 28 is inserted through the aligned eyelets 26, 26*b'* so that barriers 10 and 10*b* are fastened together. This process is continued with all the eyelets along each edge 29, 29*b* of barriers 10, and 10*b* so that barrier 10 is connected to second barrier 10*b* along edges 29, 29*b*.

Turning to FIG. 6, as illustrated for the barrier 10, a barrier of the present invention can also include means for fastening to structure 2 so that barrier can be mounted and secured to structure 2. The means for fastening to structure 2 can be a fastener included on barrier 10 or on structure 2, such as a hook on barrier 10 (not shown) similar to hook 28*b* (FIG. 7) or an eyelet 26 (FIGS. 1 and 6) for engaging a hook or other fastener 30. The means for fastening barrier 10 to structure 2 can be the same fastener that may be used to fasten barrier 10 to a second barrier 10*b*, as described above, or the means can be a separate fastener.

Other fasteners, such as zippers, Velcro, pins, clips and the like may also be used to fasten bathers of the present invention together, or to fasten barriers to structures or the like so long as the fasteners are strong enough to support the weight of a hydrated bather and the water it holds.

Superabsorbent Polymer

In order for bather 10 and bather 210 to be its most efficient in retarding fire from an object such as structure 2, the barrier should include an absorbent material that can absorb many times its own weight in water. Water-absorbent materials that are capable of absorbing many times their own weight in water usually comprise a polymer or a grafted polymeric compound, usually referred to as superabsorbent polymers, which are known to absorb between about 40 and about 400 times their weight in water. Examples of superabsorbent materials include crosslinked polymers such as polyacrylates and their derivatives, including polyacrylamide and polyacrylate salts, i.e. sodium polyacrylate or potassium polyacrylate, polyacrylate/polyacrylamide copolymers, and starch-grafted polymers. In one embodiment, superabsorbent polymer 16 is made up of small particles which can be easily poured into pockets 14 when barrier 10 is being made. In one embodiment, the particles of superabsorbent polymer 16 are sized between about 500 mesh (about 0.025 mm in diameter) and about 2 mm in diameter.

Polyacrylate salts such as sodium polyacrylate or potassium polyacrylate can absorb up to about 500 times their weight in water, or more. However, because they are salts, their absorption capacity is greatly dependent on the impurities in the water. For example, "hard water," or water with a relatively high concentration of calcium or magnesium ions, lowers the absorption capacity of potassium polyacrylate because the ions disrupt bonding between the polymer and water.

Polyacrylamide is not as affected by hard water, but does not have as high an absorption capacity as the polyacrylate salts. Polyacrylamide is known to be able to absorb between about 20 times and about 400 times its weight in water. However, even at absorption capacities as low as 100 times its weight in water, polyacrylamide can still absorb enough water to be an effective fire-retardant.

Preferably, all embodiments of the barrier of the present invention hold enough water to retard a fire from burning an object until the fire moves away from the object, or until the fire burns out. In one embodiment, superabsorbent polymer in barrier 10 is able to absorb between about 200 pounds and about 4000 pounds of water, preferably between about 260 pounds and about 2500 pounds of water, and still more preferably about 1200 pounds of water. In order to absorb the desired amount of water, between about 2 pounds and about 50 pounds of superabsorbent polymer 16 is included in barrier 10 and preferably between about 2.6 and about 24 pounds, and still more preferably about 11 pounds of superabsorbent polymer 16. The same parameters apply to barriers such as barrier 210 when of similar size.

The barrier of the present invention, including barriers 10, 110 and 210, may also hold between about ½ pound of water per square foot of barrier and about 10 pounds of water per square foot of barrier, preferably between about 2 pounds of water per square foot of barrier and about 6 pounds of water per square foot of barrier, and still more preferably about 3 pounds of water per square foot of bather. In one embodiment, for example, barrier 10 is about 20 feet long by about 20 feet wide, with a total area of about 400 square feet, and barrier can absorb about 1200 pounds of water, or about 3 pounds of water per square foot.

The amount of superabsorbent polymer 16 that is needed per square foot of bather 10 and bather 210 is equal to the amount of water desired to be absorbed, divided by the absorption capacity of superabsorbent polymer 16. For example, if it desired that about 3 pounds of water per square foot be absorbed, and a superabsorbent polymer 16 having an absorption capacity of about 100 times its own weight is used, then at least about 0.03 pounds (about 13.6 grams) of superabsorbent polymer per square foot of bather would be required. In one embodiment, barrier 10 averages between about 3 grams and about 27 grams, preferably between about 8 grams and about 25 grams, and still more preferably about 12.6 grams of superabsorbent polymer 16 per square foot of barrier 10. For barrier 210, the depth of the matrix material can be adjusted to provide the desired amount of superabsorbent polymer, or instead the amount of superabsorbent polymer impregnated in the matrix can be adjusted, or both methods can be employed.

Pockets

Turning back to FIGS. 1-4, in one embodiment, the bather 10 includes a plurality of pockets 14 connected together to form fire-retardant barrier 10 for covering a substantial area, wherein each one of the plurality of pockets 14 has a pair of fabric layers 32, 34 and a cavity 22 disposed therebetween. Substantially all of the pockets 14 hold a small amount of a superabsorbent polymer 16 in its cavity 22.

At least one of fabric layers 32, 34, i.e. the outer fabric layer 32 relative to structure 2 (see FIG. 6), is water-permeable to allow water to pass into cavity 22. Inner fabric layer 34 may also be water-permeable. Cavity 22 of each pocket 14 has a maximum volumetric capacity of between about 0.03 cubic inches and about 17 cubic inches, preferably between about ½ cubic inch and about 10 cubic inches, still more preferably about 2 cubic inches. Substantially all the pockets 14 contain between about 0.01 grams and about 2 grams of superabsorbent polymer 16 per cubic inch of volumetric capacity of cavity 22, preferably between about 0.05 grams per cubic inch and about 0.33 grams per cubic inch, still more preferably about 0.16 grams of superabsorbent polymer 16 per cubic inch of volumetric capacity.

Stitches 24 form a generally quilted pattern of pockets 14. Stitches 24 can form pockets 14 into any one of several geometric shapes including triangular shapes, quadrilaterals including squares, rectangles, diamonds, parallelograms, and trapezoids, pentagonal shapes, hexagonal shapes, octagonal shapes, circular and ovaloid shapes, or combinations of geometric shapes to form a continuous array of pockets 14 for holding superabsorbent polymer 16. In one embodiment, shown in FIGS. 1 and 2, stitches 24 form a generally quilted pattern of square pockets 14.

In one embodiment, shown in FIGS. 1 and 2, pockets 14 are generally rectangular having a length PL and a width PW, wherein length PL of between about ½ inch and about 4 inches, preferably between about 1 inch and about 3 inches, still more preferably about 2 inches, and a width PW of between about ½ inch and about 4 inches, preferably between about 1 inch and about 3 inches, still more preferably about 2 inches. In one embodiment, pockets 14 are generally square shaped, as shown in FIG. 2, and are about 2 inches long by about 2 inches wide.

In one embodiment, described above, the plurality of pockets 14 are formed by joining two sheets 18, 20 together with one or more joining elements so that pockets 14 are formed between sheets 18, 20, wherein outer water-permeable fabric layer 32 is part of outer fabric sheet 18 and inner fabric layer 34 is part of inner sheet 20. The joining elements, such as stitches 24, segment sheets 18, 20 into fabric layers 32, 34 which form pockets 14 having cavities 22 for holding superabsorbent polymer 16.

In another embodiment, pockets 14 are formed separately from a plurality of fabric layers 32, 34 and connected together, such as by stitching to form seams 36 between adjacent pockets, similar to a patchwork quilt.

When superabsorbent polymer, such as superabsorbent polymer 16, is dry, i.e. no water is absorbed, the total volume occupied by superabsorbent polymer 16 is substantially less than the maximum volumetric capacity of cavity 22 so that layers 32, 34 are normally slack. (In FIG. 3 the piles of superabsorbent polymer 16 at the stitches 24 puff out the pockets 14.) When water is applied to barrier 10, superabsorbent polymer 16 absorbs the water and expands to a volume that is much larger than its original volume. Eventually, when hydrated superabsorbent polymer 16' absorbs enough water, the polymer expands to fill essentially all of the available volume within cavity 22, pushing layers 32, 34 outwardly so that they are taut and so that pocket 14 forms a generally ellipsoidal shape by expanding cavity 22 to its maximum volumetric capacity, see FIGS. 4 and 5. The ellipsoidal shape of pockets 14 formed by hydrated superabsorbent polymer 16' has a maximum thickness T, see FIG. 5. In one embodiment, pockets 14 have a thickness T of between about ¼ inch and about 4 inches, preferably between about ¾ inch and about 2½ inches, still more preferably about 2 inches.

The maximum volumetric capacity acts to limit the maximum amount of water that a particular pocket can absorb because it limits the volume to which superabsorbent polymer 16 can expand. The expansion force created by superabsorbent polymer 16 against layers 32, 34 is not high enough to break the hold of the joining elements or to tear layers 32, 34. Once hydrated superabsorbent polymer 16' has expanded pocket 14 to its maximum volumetric capacity, layers 32, 34 prevent superabsorbent polymer 16 from expanding further, and therefore prevents the polymer from absorbing any more water. The volumetric capacity of each pocket 14 depends on the cross sectional area of the pocket, i.e. length PL multiplied by width PW for pocket 14 shown in FIG. 2.

Because bather 10 will be protecting a large area, such as an entire structure 2, it is also desirable for barrier 10 to hold a sufficient amount of water per square foot so that barrier 10 will be able to retard fire evenly across a large area. For this reason, superabsorbent polymer 16 is compartmentalized in pockets 14, as described below, wherein there are a predetermined number of pockets per square foot, with each pocket 14 holding at least enough superabsorbent polymer 16 so that barrier 10 will absorb the desired amount of water per square foot. For quick hydration, the barrier 10 is loaded with excess superabsorbent polymer to that the superabsorbent polymer does not approach reaching its maximum hydration capacity at the point the pockets are expanded to tautness.

Preferably, superabsorbent polymer, such as superabsorbent polymer 16, is evenly dispersed across a barrier such as barrier 10 and barrier 210. In one embodiment, between about 0.001 grams and about 35 grams, preferably between about 0.005 grams and about 3 grams, still more preferably about 0.35 grams of superabsorbent polymer 16 is placed in each pocket 14. If barrier 10 includes a plurality of pockets 14 each having essentially the same volumetric capacity, such as square pockets 14 shown in FIG. 2, then an equal amount of superabsorbent polymer 16 should be placed in each pocket 14. However, if there are pockets having different sizes, for example a quilted pattern of square pockets and hexagonal pockets, than more superabsorbent polymer 16 will be placed in larger-sized pockets than in relatively smaller-sized pockets.

It was expected that if a flammable fabric 12 were used, a fire would contact surface 21 of fabric 12, and the intense heat would quickly evaporate the water at surface 21, drying fabric 12. It was then expected that the dry fabric 12 would ignite and burn away, causing superabsorbent polymer 16 to fall out of barrier 10. If this did not occur, the other expected result was that the fire would quickly evaporate all the water from superabsorbent polymer 16, which is also combustible, and that both fabric 12 and superabsorbent polymer 16 would burn.

Surprisingly, it has been found that the barrier of the present invention, as illustrated in detail here using bather 10, does not go through this mode of action. Rather, it has been found that barrier 10 goes through the unexpected process of the fire heating the water, superabsorbent polymer 16, and fabric 12 so that steam is generated at surface 21 of barrier 10. The steam forms a steam layer 38 which acts as a fire extinguisher to prevent fabric 12 from igniting by displacing oxygen to quench any flame 40 that may try to form at surface 21 so that bather 10 is self-protecting. As mentioned above, steam is a gas that does not support combustion. The water absorbed in barrier 10 also absorbs a large amount of heat from the fire and keeps barrier 10 at the boiling point of water, 100° C.

In more detail, water alone is a conductor. The superabsorbent polymer 16 of the barrier 10 and the water absorbed thereby, however, form a substantially continuous matrix of superabsorbent polymer and hydration water that acts as a temperature buffer, maintaining the barrier 10 at the boiling point of water, 100° C. The fast heat transfer through the continuous matrix of hydrated superabsorbent polymer boosts the critical heat-buffering property of the bather 10.

Method

A method of retarding fire is also provided having the steps of providing a plurality of fire-retardant barriers, such as barriers 10, 110 and 210, covering substantially all of an object, such as a structure 2, or an expanse of land, with the plurality of fire-retardant barriers, and hydrating the hydric members of the bathers, which entails hydrating the foamed polymer or superabsorbent polymer in the fire-retardant barriers 10, 110 or 210. The most common hydration methods are spraying water onto water-permeable surfaces of the bathers and immersion of the barriers in a supply of water. In any event, water must be brought into contact with one or more water-permeable surfaces and allowed to permeate through such surface or surfaces. The hydration step might be performed before or after the covering step, depending on the practicalities presented by the circumstances.

If it is believed that a fire will encounter a particular object, a plurality of fire-retardant barriers of the present invention can be used to cover the object, as illustrated for barrier 10. Covering an object, i.e. a structure 2 such as the house shown in FIG. 9, may include the steps of placing barriers 10 on the roof of structure 2 in order to cover the roof, fastening bathers 10 together so that the plurality of barriers 10 form a generally continuous cover for covering substantially all of the roof, and hanging barriers 10 off the roof so that they hang down to the ground to cover substantially all of the walls of structure 2. Barriers 10 can be hung so that the bottom edge of the barrier is even with the ground (as with bather 10*d* in FIG. 9), spaced from the ground, or the barrier may extend beyond the base of structure 2 so that a portion of the bather lies on the ground (as with barrier 10*e* in FIG. 9) to help prevent spaces between barrier 10 and the ground from forming through which flames can pass. After barriers 10 have been placed on the roof and hung down to cover the walls, substantially all of structure 2 should be covered.

Figure 9:
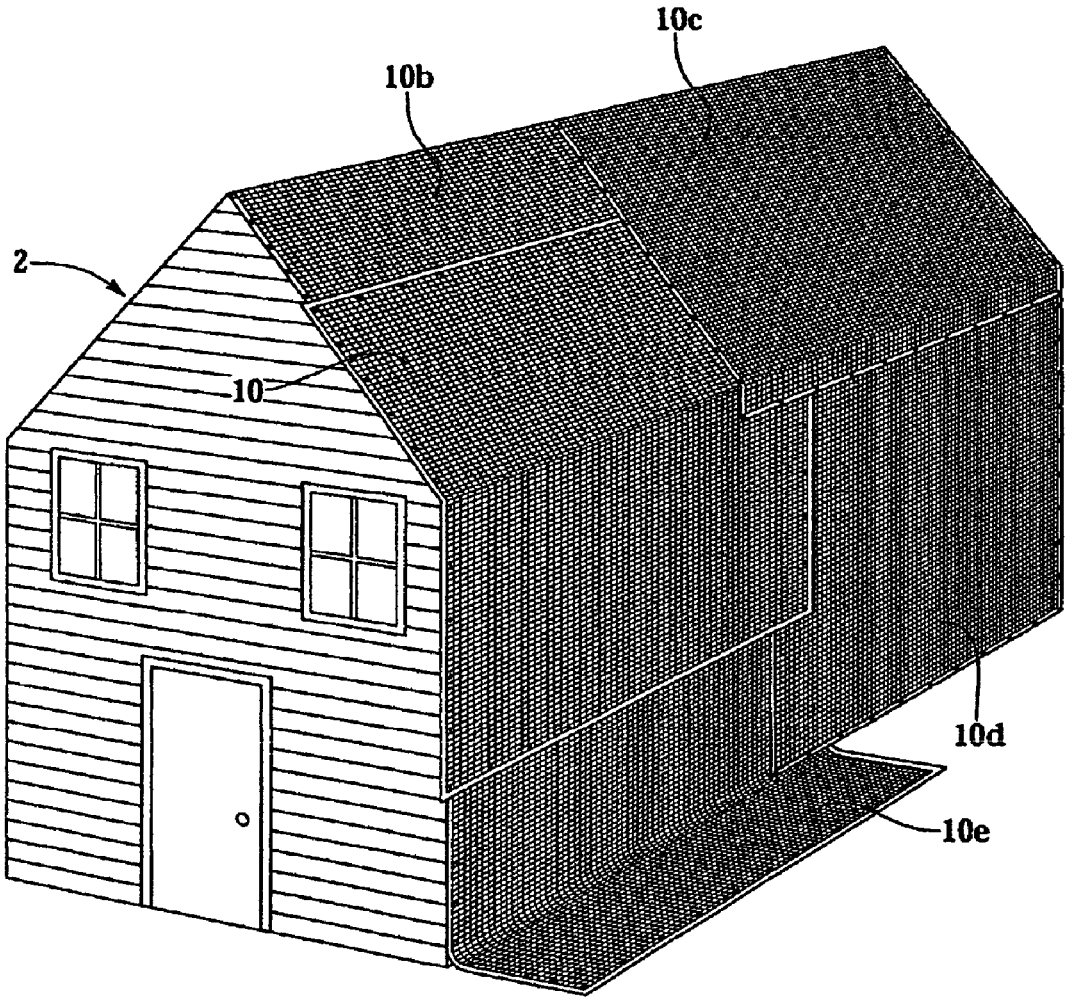
FIG. 9 is a perspective view of a plurality of fire-retardant bathers covering the structure.

The step of hanging barriers of the present invention, such as barriers 10 illustrated, to cover objects such as structure 2 can be accomplished either by fastening barriers 10 directly to structure 2 or by fastening them to the barriers 10 that have been laid on the roof. Barriers 10 can be laid on structure 2, as shown in FIG. 9, so that barriers 10 lie across the roof of the building and hang down over the exterior walls. Barriers 10 can also be fastened directly to structure 2, see FIG. 6. In one method, substantially all of the barriers 10 are fastened to structure 2 so that bathers 10 are not required to be fastened to one another. Fastening barriers 10 to structure 2 can be accomplished with fasteners 28 on bather 10, or separate fasteners 30 connecting structure 2 to barrier 10, such as hooks 30 that are received by eyelets 26 on bather 10, as shown in FIG. 6.

The method can also include the step of fastening the plurality of barriers, such as bathers 10 illustrated, together, such as with fasteners, including hooks 28*b* or eyelets 26 as shown in FIG. 7. Fastening bathers 10 together can include covering a portion of structure 2 with a first bather 10*a* followed by connecting a second bather 10*b* to first barrier 10*a*, such as with fasteners. A third bather 10*c* can be connected either to first barrier 10*a*, second bather 10*b*, or a portion of third barrier 10*c* can be connected to first bather 10*a* while another portion is connected to second barrier 10*b*. This process can be repeated with additional barriers until substantially all of building is covered. The plurality of barriers 10 can also be laid out to cover the desired area and then fastened together. Barriers 10, 10*a*, 10*b*, 10*c* may be overlapped, as shown in FIGS. 6-9 to ensure that burning materials or hot air do not bypass the bathers and ignite structure 2.

Hydrating the hydric member of the barrier of the present invention, whether it contains superabsorbent polymer or not, can be accomplished by spraying water onto barriers so that the sprayed water is absorbed by the superabsorbent polymer or foam-polymer. No special equipment is needed to spray water on barriers. For example, a garden hose may be sufficient. In some cases, it may be desirable to provide enough water pressure to ensure the water can reach the roof of, for example, structure 2 from the ground, such as with a water booster pump, so that an operator of the hose or sprayer does not have to climb a ladder during the rushed operation of hydrating barriers while a fire is bearing down on a structure. Barriers of the present invention can also be rehydrated as the fire evaporates the water out of barrier by reapplying water to barrier to prolong the life of barrier.

Because of its absorbent nature, both superabsorbent polymer and most foamed polymer suitable for use in the present invention, absorb the sprayed water quickly so that the step of hydrating barriers is a relatively short operation. This allows a home owner or building maintenance person to cover a structure with bathers well before a fire is expected, but wait to hydrate the bathers until they are more certain a fire will come into contact with the structure. Because of the large amount of water superabsorbent polymer or foamed polymer can absorb, a barrier that has been hydrated, depending on its size and degree of hydration, might be heavy and difficult to manipulate. For example, when bather 10 has a total of 3600 pockets, each holding about 3 grams of superabsorbent polymer 16, the total hydrated weight of barrier 10 is about 2400 pounds, making it difficult to move barrier 10 once it has been hydrated. The ability of a home owner or building maintenance person to wait to hydrate bather 10 until they are sure it is necessary is particularly advantageous because a user will most likely wish to avoid hydrating barrier 10 unless a fire is fairly certain to pass through, making hydration necessary to protect structures.

In some embodiments of the invention, hydrating the superabsorbent polymer or the foamed polymer of the barriers prior to placement is the better approach, particularly when the bather is comprised of a multitude of small hydric members and/or when the barrier will be placed in an inaccessible location.

One method of removing barriers 10 from structure 2 is by opening pockets 14 so that hydrated superabsorbent polymer 16' falls out of cavities 22. Hydrated superabsorbent polymer 16' is biodegradable so that it can be disposed of safely, or so that it can be left out to degrade onto soil. Pockets 14 can be opened by cutting open pockets 14, such as by slicing or tearing layers 32, 34 or stitches 24, or pockets 14 can be made to be openable and reclosable, such as with zippers or other means. After superabsorbent polymer 16' is removed from pockets 14, fabric 12 of barrier 10 can be removed by lifting it off structure 2. Another method of removing barriers includes cutting barrier 10 along stitches 24 in order to remove entire rows of pockets 14 at a time.

In another method, a plurality of barriers are used as a firebreak to prevent the spread of a fire through brush or other flammable material. In one embodiment, this method includes placing a first barrier on the material to be protected, placing a second barrier adjacent to the first bather, placing a third barrier adjacent to the second bather, etc. Subsequent bathers are continuously laid onto the material to be protected until the desired area is covered. After the bathers are placed, the step of hydrating the hydric member of the bather, which may or may not include superabsorbent polymer, is carried out. Hydrating the barriers can commence after all the barriers have been placed, or hydrating can be performed while barriers are still being placed to ensure rapid deployment of the firebreak.

In another embodiment, the hydric members of a barrier of the present invention are hydrated prior to, or during, transport to the site of use. Hydration prior to placement of the hydric members is particularly of value when the hydric members are dropped into place because the water absorbed therein will provide sufficient density to the hydric members, permitting a reasonably targeted drop-placement method feasible. For instance, a plurality of hydric members can readily be dumped out of airtankers to provide a discontinuous array of hydrated hydric members on the ground or caught upon vegetation. An array of hydrated hydric members are far more effective a fight against wildfire, and far less environmentally harmful, than dumping fire retardant in wildfire areas. The hydric members are benign and therefore far easier and safer to handle, transport and distribute. They may be hydrated prior to transport or hydrated during transport in the tanks of airtankers. Their weight after hydration and their integrity as structural entities permit them to dropped with reasonable accuracy into target areas.

The method of the present invention in embodiments includes the steps of volatizing a portion of the water absorbed in the hydric member or members at a temperature of about 100° C. to form a layer of steam at the water-permeable surface or surfaces, and deterring ignition of the hydric member or members, and any part thereof, and preventing flames from reaching the material protected (the fuel) by substantially extinguishing flames of a fire with the facing steam layer. As mentioned above, steam is a gas that does not support combustion.

The method of the present invention in embodiments includes the steps of dissipating the steam layer upon the retreat or burn-past of the fire, and then optionally removing the barrier or barriers. The self-protecting nature of the fire-retardant barrier of the present invention permits them to survive in instances when steaming does not proceed to the point of water depletion. When the hydric members are small and portable, recovery and even reuse is feasible.

System

The system of the present invention is simply the self-protecting bather system embodied in the method of the present invention. In fundamental embodiments the system includes a hydrated fire-retardant barrier of the present invention at a temperature of about 100° C., a fire adjacent the barrier and a layer of steam at a surface of the barrier, between the barrier and the fire. In further embodiments, the system of the invention includes fuel adjacent the barrier, opposite the fire, and optionally a layer of steam at a second surface of the barrier, between the barrier and the fuel. In embodiments, the surface of the barrier adjacent the fire is substantially unburned, and will remain so as long as the steam layer continues.

The apparatus and method of using bather 10 are exemplified in the following examples, which are in no way limiting of the scope of the present invention.

Example 1

Two small, substantially identical piles of wood two-by-twos, or "houses," are erected proximate each other on a grass field. One house is an experimental house which is to be protected by a fire-retardant barrier and the other is a control house which is to be left unprotected. Each house is constructed from 18 two inch-by-two inch wood blocks, each block being about 6 inches long. The blocks are stacked into 3 levels, with each level comprising 6 blocks arranged in a 3 block by 2 block grid with air spaces in between. The two-by-two blocks of the houses are labeled and weighed individually to determine if there is any weight loss due to burning during the experiment.

Two fire-retardant barriers are provided, each barrier being about 24 inches by about 22.5 inches and including two sheets of cotton muslin fabric sewed together with stitches. The stitches form a quilted pattern of substantially rectangular pockets arranged 9 pockets long by 6 pockets wide, wherein each pocket is about 2.5 inches by about 4 inches. Each pocket holds about 1 gram of superabsorbent polyacrylamide polymer that is in the form of generally spherical particles having a diameter of about 0.25 mm.

The bathers are soaked by immersion in water in order to fully hydrate the bathers to tautness by hydrating the superabsorbent polyacrylamide polymer. After soaking the bathers, they are placed over the experimental house, with one bather overlapping a portion of the other, while the control house remains uncovered.

Two 75 pound bales of dry straw are uniformly spread over and around the control house and the experimental house. The straw is spread evenly around and on top of both the protected experimental house and the control house. The straw is ignited and allowed to burn.

After about an hour, residual ash from the burned straw is removed from around the houses. The control house, i.e. the house not covered by a fire-retardant barrier, is completely burned and reduced essentially to embers and ash.

The fire-retardant bathers are removed from the experimental house and examined. The outer sheet of the barrier appears to be sooted by the ash from the burning straw and is darker in color, but otherwise the barriers are undamaged and intact. There is an absence of any singeing on the outer sheet. The wood two-by-twos used to construct the experimental house surprisingly are totally unaffected by the fire. In addition to the wood two-by-twos of the experimental house being protected from the fire during the experiment, it was noted that the grass that was around the control house had been charred and blackened, but that the grass that had been underneath the bathers was unburned and still green.

The weights of the blocks of the unprotected control house before and after the experiment are shown in the following table:

| Block # | Weight Before Fire (grams) | Weight After Fire (grams) |
|---|---|---|
| 1 | 118.22 | * |
| 2 | 117.36 | * |
| 3 | 118.10 | * |
| 4 | 118.93 | * |
| 5 | 118.38 | * |
| 6 | 119.01 | * |
| 7 | 118.65 | * |
| 8 | 117.68 | * |
| 9 | 118.22 | * |

-continued

| Block # | Weight Before Fire (grams) | Weight After Fire (grams) |
|---|---|---|
| 10 | 118.39 | * |
| 11 | 117.87 | * |
| 12 | 118.70 | * |
| 13 | 117.98 | * |
| 14 | 117.79 | * |
| 15 | 118.18 | * |
| 16 | 118.73 | * |
| 17 | 118.56 | * |
| 18 | 118.63 | * |

The weight of each block after the fire is indicated as a * to show that all that remained of each block was ashes and embers, which were not weighed.

The 18 two-by-two blocks of the experimental house are weighed individually to determine any weight change during the experiment. The weights of the blocks of the protected experimental house are shown in the following table:

| Block # | Weight Before Fire (grams) | Weight After Fire (grams) |
|---|---|---|
| 1 | 118.89 | 118.93 |
| 2 | 118.12 | 118.23 |
| 3 | 117.97 | 117.91 |
| 4 | 119.01 | 119.02 |
| 5 | 118.56 | 118.53 |
| 6 | 116.99 | 116.99 |
| 7 | 117.87 | 117.78 |
| 8 | 117.80 | 117.82 |
| 9 | 118.67 | 118.69 |
| 10 | 118.43 | 118.47 |
| 11 | 118.76 | 118.80 |
| 12 | 118.22 | 118.26 |
| 13 | 118.29 | 118.32 |
| 14 | 117.87 | 118.90 |
| 15 | 117.89 | 117.86 |
| 16 | 118.58 | 118.54 |
| 17 | 118.29 | 118.34 |
| 18 | 118.89 | 118.86 |

Example 2

A plurality of fire-retardant barriers is used to protect a 75 foot by 40 foot (3000 square foot) house. Each fire-retardant barrier is 20 feet 2 inches long by 20 feet 2 inches wide to allow for 20 foot by 20 foot coverage per barrier with an overlap of 2 inches along the periphery of each barrier. The bather includes 14,641 pockets that are 2 inches by 2 inches. Each pocket has a volume of about 35 $cm^3$ so that the water absorbed into each pocket weighs about 35 grams. 0.35 grams of superabsorbent polymer is placed in each pocket so that there is a total of about 11.3 pounds of superabsorbent polymer per barrier. The total weight of each bather before hydration is about 20 pounds. The total weight of each barrier after hydration is about 1,140 pounds, so that each barrier has a weight of about 2.85 pounds per square foot. A total of 26 barriers are used to cover the roof and the walls of the house.

The plurality of barriers are applied to the house by placing a folded first barrier on the roof, followed by unfolding the first barrier, placing a second bather adjacent to the first bather and unfolding the second bather, and ensuring that about 2 inches of the second barrier overlaps the first barrier. Subsequent barriers are placed on the roof in substantially the same manner until substantially all the roof is covered, after which the barriers are fastened together. Additional barriers are hung off the edge of the roof to cover the walls of the house. The barriers can be hung off the roof by either fastening the hanging barriers to the barriers that already are placed on the roof, or by fastening the hanging barriers directly to the house. After substantially the entire house is covered, the user hydrates the bathers with a garden house until all of the barriers are hydrated.

As described above, steam is formed by volatilizing the water absorbed by the barrier, and the steam helps to extinguish the fire at the bather. The volume of steam generated can be approximated using the ideal gas law:

$$V = \frac{mRT}{\mathrm{MW}}$$

wherein V is the volume of steam formed, m is the mass of the steam formed, R is a constant which is approximately 0.082 atmospheres-liter/(° Kelvin-mole), T is the temperature in ° K, which will be the boiling point of water, or 373° K, and MW is the molecular weight of water, or 18 grams/mole.

Therefore, each superabsorbent polymer filled pocket, or other hydric member, which holds 35 grams of water, can liberate about 59.5 liters of steam before the water is exhausted. Each barrier of 14,641 pockets can liberate a total of about 871,000 liters of steam, and the total system of 26 barriers can liberate about 2,265,000 liters of steam. The same order of steam generation is seen in other embodiments of the invention, such as barriers 110 and 210.

As the steam is formed, the water absorbs heat from the fire. The heat absorbed by the water can be approximated by a change in enthalpy calculation:

$$\Delta H = H_1 + [C_p(2) - C_p(1)]*(T_2 - T_1)$$

wherein ΔH is the heat absorbed in calories, $T_1$ is the initial temperature of the water, assumed to be about 25° C., or 298° K, $T_2$ is the final temperature of the steam, assumed to be 100° C., or 373° K, $C_p(1)$ is a constant of 1.0 calories/(° K-gram) for water, $C_p(2)$ is a constant of 0.444 calories/(° K-gram) for steam, and $H_1$ is the heat of vaporization of water, which is 539.7 calories/gram.

Therefore, each gram of water in the barrier can absorb about 498 calories of heat from the fire as it is vaporized into steam. Each superabsorbent polymer filled pocket holds about 35 grams of water, so that each pocket can absorb about 17,430 calories of heat, or about 69.2 BTU. Each barrier of 14,641 pockets can absorb about 255,200,000 calories, or about 1,013,000 BTU of heat, and the entire system of 26 barriers can absorb about 663,500,000 calories, or about 26,340,000 BTU of heat from the fire before the water is exhausted. The same order of heat absorption is seen in other embodiments of the invention, such as barriers 110 and 210.

Example 3

A plurality of fire-retardant bathers is used as a firebreak in an area that is heavily covered by scrub brush and other combustible biological material. Each barrier is about 100 feet long by 50 feet wide and allows for about 2.5 feet on each side for overlap, providing a linear coverage of about 95 feet. Each pocket is 1.5 inches by 1.5 inches so that there are a total of 320,000 pockets. Each pocket has a volumetric capacity of about 15 $cm^3$. 0.15 grams of superabsorbent polymer is placed in each pocket, and each pocket is capable of absorbing about 15 grams of water. The weight of the superabsorbent polymer per barrier is about 105 pounds. The weight of each barrier before hydration is about 150 pounds, and the weight of the barrier after hydration is about 10,600 pounds. In order to cover a linear distance of about 5 miles, 278 barriers are required.

The firebreak is put together by fire fighters or other users by placing a first folded bather on the scrub brush and unfolding the barrier out to its full length and width, followed by placing a second bather adjacent to the first bather so that about 2.5 feet of the length of the second barrier overlaps the first barrier, then unfolding the second barrier to its length and width. The process is repeated with subsequent barriers until substantially all of the 5 miles is covered by the plurality of barriers. Hydrating the barriers can be accomplished with a tank wagon, an airplane, a nearby river or reservoir, or another source of water large enough to hydrate the barriers. The barriers can be hydrated after they have all been placed along the five miles of firebreak, or the bathers can be hydrated as they are placed in position to ensure rapid deployment.

Wilderness fire-fighting tactics often employ helicopters and/or airplanes to reach otherwise inaccessible regions. These aircraft transport slings, reservoirs and/or other water-holding containers and drop the water on the fire or path of the fire. The drawbacks of this type of water delivery include, without limitation, water loss through evaporation, soil absorption, drain-away and run-off. Only a fraction of the water delivered to a site is retained on fuel surfaces, such as grass, underbrush, trees and other fuel sources. Gravity and the liquidity of water therefore prevent a full realization of the fire-retarding and fire-extinguishing potential of the water delivered, and in turn require the delivery of excessively high volumes of water.

These drawbacks of current water-delivery methods in wilderness fire-fighting procedures are substantially eliminated when hydrated barriers of the present invention are used instead of free-flowing water. The barriers normally can be transported to the fire site in the same containers and using the same aircraft. The barriers can be pre-hydrated where free-flowing water would otherwise be loaded onto the aircraft. The barrier hydration might, in some instances, be accomplished en route to the fire by loading unhydrated or partially hydrated barriers together with hydration water.

Further, the elimination of water loss through evaporation, soil absorption, drain-away and run-off is not the only benefit realized by the use of barriers of the present invention. The barriers will cloak the fuel sources, regardless of whether they are grass, underbrush, trees or other objects. The large sink of water contained in each discrete barrier will generate a significant amount of steam that will retard, extinguish or redirect a remote fire.

In addition, dropping hydrated barriers of the present invention from aloft is a technique not limited to fighting wilderness fires. It can also be employed to protect other difficult to reach fuel surfaces such as rooftops, treetops, tall monuments, ships or barges, and the like.

Wilderness Fire Fighting Example

Figure 12:
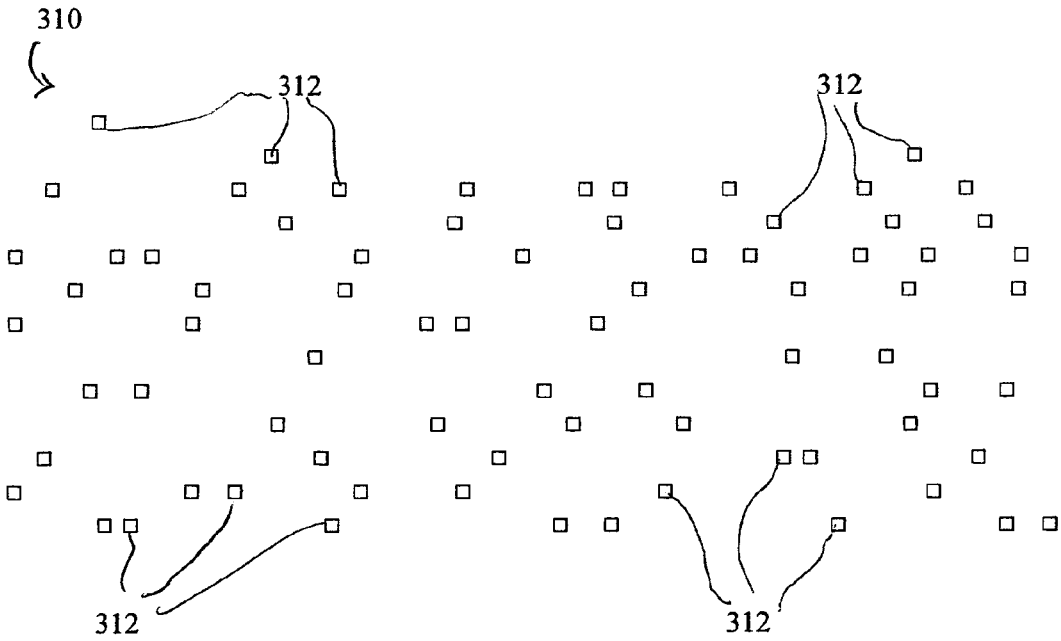
FIG. 12 is a top plan partially diagrammatic view of barrier of the present invention comprised of a plurality of hydric members randomly dispersed across an area.

The barrier 310 illustrated in FIG. 12 is employed to retard a fire in a remote wilderness location. The barrier 310 has a multitude of small hydric members 312. Each hydric member 312 is about 0.5 inch square, dry dimensions, and is a packet formed of a lightweight, flammable and water-permeable material such as a simple cotton cloth. Each hydric member 312 contains about 0.2 grams of superabsorbent polymer. The hydric members 312 are loaded to a transportable delivery container system such as a mesh sling, and then hydrated. Each of the hydric members 312 will absorb about 2 grams of water. The number of hydric members 312 used would be determined and restricted by the weight capacity of the delivery system, such as a helicopter or airplane. If the payload of the aircraft, such as a helicopter, is about 2,500 pounds, then about 500,000 hydric members can be air lifted, each containing hydrated superabsorbent polymer in the amount of about 0.2 grams dry weight of superabsorbent polymer. The aircraft then carries the hydric members 312 out to the remote site and drops the hydric members 312, dispersing them over an expanse of land to retard the fire. When a barrier is comprised of a plurality of hydric members, the hydric members need not form a continuous array upon placement. A discontinuous array is sufficient.

Using the estimations of the example above, it is further noted that each gram of absorbed water can take up about 498 calories of heat from the fire as it is vaporized into steam. Each hydric member 312 will take up about 996 calories of heat as it steams and eventually becomes the water is exhausted. Therefore the 500,000 hydric members collectively will absorb about 480,000,000 calories or about 1,970,000 BTU of heat from the fire before the water is exhausted.

The drop-delivery method is of course not limited to barriers formed of a multitude of hydric members, or to hydric members containing superabsorbent polymer. For example, hydrated foamed-polymer barriers are sufficiently dense to be dropped into place, regardless of whether the bathers have a single or a multiplicity of hydric members.

The barriers of the firebreak produce steam as they are heated. The ideal gas law, described above, is used to approximate the amount of steam created. Each superabsorbent polymer filled pocket of the firebreak barriers 10 can liberate about 25.5 liters of steam so that each barrier can liberate about 8,160,000 liters of steam, and the entire firebreak of 278 barriers can liberate about 2,270,000,000 liters of steam before the water is exhausted.

By approximating the heat absorbed using a change in enthalpy calculation, described above, it was determined that each pocket of the firebreak barriers 10 can absorb about 7,470 calories, or about 29.7 BTU of heat, so that each barrier can absorb about 2,390,000,000 calories, or about 9,490,000 BTU of heat from the fire, and the entire firebreak can absorb about 664,500,000,000 calories, or about 2,638,000,000 BTU of heat from the fire before the water is exhausted.

In partial summary of the present invention, the present invention provides a self-protecting bather for retarding fire. The barrier is comprised of at least one hydric member. The hydric member has at least one water permeable surface and has a water absorption capacity in terms of pounds of water per square foot of the surface area sufficient for fire retardation. In preferred embodiments, the hydric member has a water absorption capacity of from about 0.5 to about 10 pounds of water per square foot of the surface area. In preferred embodiments, the hydric member is a foamed polymer, or a matrix, preferably a cellulosic matrix, containing superabsorbent polymer, or a pocket or pouch containing loose superabsorbent polymer. In further preferred embodiments, the superabsorbent polymer is a polyacrylate-derivative superabsorbent polymer or a polyacrylamide superabsorbent polymer.

The present invention also provides a hydrated self-protecting barrier in a system for retarding fire. The barrier is comprised of at least one hydric member having at least one water-permeable surface and an absorbed-water loading sufficient for fire retardation. In preferred embodiments the water loading is in an amount of from about 0.5 to about 10 pounds of water per square foot of the surface area of the of the water-permeable surface. In the system, the hydric member is at a temperature of about 100° C., and has at least one water-permeable surface adjacent to, and facing, a fire, and a layer of steam at that surface and interposed between that surface and the fire. In further embodiments, the system includes fuel on the side of the hydric member opposite the fire. The fuel is at a temperature not exceeding about 100° C., and is substantially unburned. In further embodiments, the hydric member has a water-permeable surface facing the fuel and a layer of steam at such surface, between the hydric member and the fuel.

The present invention also provides a method of retarding fire from burning a substance. The method employs a self-protecting fire-retardant barrier which has at least one hydric member. The hydric member has a water-permeable surface. The hydric member has a water loading sufficient for fire retardation. In preferred embodiments of the method, the hydric member has a water loading of from about 0.5 to about 10 pounds of water per square foot of the surface area of the water-permeable surface. The method is comprised of the steps of providing at least one fife-retardant barrier, covering at least a substantive portion of the substance with at least the one fire-retardant barrier, while positioning the fire-retardant barrier with at least part of the surface outward, and hydrating the hydric member to from about 0.5 to about 10 pounds of water per square foot of the surface area. In preferred embodiment, the method further includes the step of allowing the water to form a steam layer at the surface.

The present method also provides a method of isolating fuel from the flames of a fire. This method employs a fire retardant barrier described above, and comprises the steps of providing at least one fire-retardant barrier between the fuel and the flames and allowing a steam layer to form at the surface of the barrier. In some embodiments, the method also includes the steps of allowing the steam layer to dissipate, and then removing the barrier. In some embodiments, the barrier is comprised of a plurality of the hydric members and the barrier is provided between the fuel and the flames by dropping the hydric members, including dropping them from an elevated height onto an expanse of land.

In summary, the present invention provides a self-protecting bather for retarding fire. The barrier in broad embodiment is a combustible hydric member or a network of combustible hydric members having an ignition temperature above the boiling point of water, or in other words, above 100° C. The hydric member or members have at least a first surface which is water-permeable and may be flammable. The hydric member or network of hydric members has a sufficient water absorption capacity for fire retardation. As described above, the hydric members may be foamed-polymer elements, or superabsorbent polymer-filled matrixes, or loose superabsorbent polymer-filled pouches or pockets.

Further in summary, the present invention provides a self-protecting barrier system for retarding fire. The system in broad embodiment includes a network of combustible water-hydrated hydric members, steam and fire. The water-hydrated hydric members each have an ignition temperature above 100° C. and flammable, water-permeable and substantially unburned external surfaces. The water-hydrated hydric members are at a temperature of about 100° C. The fire is adjacent the external surfaces of the hydric members and the steam is between the external surfaces and the fire.

A plurality of the water-hydrated hydric members may be (a) wet foamed-polymer elements, such as wet polyurethane elements, (b) hydrated superabsorbent polymer-filled matrixes, such as hydrated superabsorbent polymer-filled cellulosic matrixes, (c) pouches substantially filled with substantially continuous matrixes of hydrated superabsorbent polymer, (d) pockets of a fabric quilt substantially filled with substantially continuous matrixes of hydrated superabsorbent polymer, and the like.

The system may further include a combustible and substantially unburned object adjacent the hydric members opposite the fire. When the hydric members have water-permeable interior surfaces opposite the exterior surfaces and facing such object, the system may further include steam between the object and the interior surfaces. The hydric members of such system may have a water loading of from about 0.5 to about 10 pounds of water per square foot of the surface area, and other details described above.

Further in summary, the present invention provides a method of isolating a combustible object from the flames of a fire. This method includes the steps of providing at least one fire-retardant barrier between the object and the flames. Such barrier has at least one water-hydrated hydric member comprised of combustible material and hydration water. The hydric member has a first flammable and water-permeable surface facing and exposed to the flames. Additional basic steps of the method are volatilizing or boiling a portion of the hydration water at a temperature of about 100° C. to form a first steam layer at the first surface and deterring ignition of the hydric member and preventing the flames from reaching the object by substantially extinguishing the flames with the first steam layer.

The method may also include the steps of allowing the first steam layer to dissipate, and then removing the barrier. When the barrier is a plurality of the hydric members, and the object is vegetation, the method may include the step of providing the barrier between the vegetation and the flames by dropping the hydric members from an elevated height onto an expanse of land. When the hydric member has a water-permeable second surface facing and exposed to the object, the method may include the further step of volatilizing or boiling a portion of the hydration water at a temperature of about 100° C. to form a second steam layer at the second surface.

As used herein, the terms combustible and flammable mean that a substance is capable of igniting and burning. In other words, the terms flammable and combustible are used in their ordinary sense herein to mean able to catch on fire and burn under ordinary conditions such as exposure to fire, and this definition excludes fire resistant materials or materials with fire-resistant coatings. This definition may or may not comport with governmental regulatory definitions.

As used herein, ignition temperature means the lowest temperature at which a substance will catch on fire and continue to burn. This is the ordinary definition of ignition temperature. This definition may or may not comport with governmental regulatory definitions.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A self-protecting barrier system for retarding fire comprising:

a network of combustible hydric members each having an ignition temperature above 100° C.;

said hydric members having flammable, water-permeable external surfaces;

said hydric members being adapted to generate steam at said external surfaces when said hydric members are sufficiently water hydrated and then exposed to fire adjacent said external surfaces at a temperature of about 100° C., wherein said hydric members have water-permeable interior surfaces opposite said exterior surfaces and said system further comprises a combustible object adjacent said interior surfaces, wherein said hydric members are adapted to generate steam between said object and said interior surfaces when said hydric members are sufficiently water hydrated and then exposed to fire.

2. A self-protecting barrier system for retarding fire according to claim 1 wherein a plurality of said hydric members are foamed-polymer elements.

3. A self-protecting barrier system for retarding fire according to claim 1 wherein a plurality of said hydric members are polyurethane elements.

4. A self-protecting barrier system for retarding fire according to claim 1 wherein a plurality of said hydric members are superabsorbent polymer-filled matrixes.

5. A self-protecting barrier system for retarding fire according to claim 1 wherein a plurality of said hydric members are superabsorbent polymer-filled cellulosic matrixes.

6. A self-protecting barrier system for retarding fire according to claim 1 wherein a plurality of said hydric members are pouches containing a sufficient amount of superabsorbent polymer so as to, upon water hydration, be substantially filled with substantially continuous matrixes of hydrated superabsorbent polymer.

7. A self-protecting barrier system for retarding fire according to claim 1 wherein a plurality of said hydric members are pockets of a hydrophilic fabric quilt containing a sufficient amount of superabsorbent polymer so as to, upon water hydration, be substantially filled with substantially continuous matrixes of hydrated superabsorbent polymer.

8. A self-protecting barrier system for retarding fire according to claim 1 further comprising a combustible object adjacent said hydric members opposite said fire.

9. A self-protecting barrier system for retarding fire according to claim 1 wherein said external surfaces have a surface area and said hydric members have a water loading of from about 0.5 to about 10 pounds of water per square foot of said surface area.

10. A method of isolating a combustible object from the flames of a fire, comprising the steps of:

providing at least one fire-retardant barrier between said object and said flames, said barrier having at least one water-hydrated hydric member comprised of combustible material and hydration water, said hydric member having a first flammable and water-permeable surface facing and exposed to said flames;

volatilizing or boiling a portion of said hydration water at a temperature of about 100° C. to form a first steam layer at said first surface; and deterring ignition of said hydric member and preventing said flames from reaching said object by substantially extinguishing said flames with said first steam layer.

11. A method of isolating a combustible object from the flames of a fire according to claim 10, further including the steps of allowing said first steam layer to dissipate, and then removing said barrier.

12. A method of isolating a combustible object from the flames of a fire according to claim 10, wherein said barrier is comprised of a plurality of said hydric members, wherein said object is vegetation, further including the step of providing said barrier between said vegetation and said flames by dropping said hydric members from an elevated height onto an expanse of land.

13. A method of isolating a combustible object from the flames of a fire according to claim 10, wherein said hydric member has a water-permeable second surface facing and exposed to said object, further including the step of volatilizing or boiling a portion of said hydration water at a temperature of about 100° C. to form a second steam layer at said second surface.

* * * * *